United States Patent [19]

Marlow

[11] 4,122,739

[45] Oct. 31, 1978

[54] MITERING DEVICE FOR WOOD AND METAL PICTURE FRAMES

[76] Inventor: Glenn Marlow, 3523 Robin Dr., Louisville, Ky. 40216

[21] Appl. No.: 798,444

[22] Filed: May 19, 1977

[51] Int. Cl.[2] ..... B27B 27/06

[52] U.S. Cl. ..... 83/421; 83/435.1; 83/477.2; 83/468; 83/581

[58] Field of Search ..... 83/421, 431, 432, 435.1, 83/468, 474, 475, 476, 477.2, 581; 269/303–309

[56] References Cited

U.S. PATENT DOCUMENTS

| | | | |
|---|---|---|---|
| 2,881,812 | 4/1959 | Alumbaugh et al. | 83/435.1 |
| 2,894,543 | 7/1959 | Ivy, Jr. | 83/477 |
| 2,905,210 | 4/1959 | Thomas | 83/435.1 X |
| 3,941,020 | 2/1976 | Huntley et al. | 83/477.2 |
| 3,986,420 | 10/1976 | Huntley et al. | 83/435.1 |

FOREIGN PATENT DOCUMENTS

| | | | |
|---|---|---|---|
| 12,423 | 3/1903 | Norway | 83/477 |

*Primary Examiner*—J. M. Meister

[57] ABSTRACT

In the art of making mitered frame members on a work table associated with an operatively mounted mitering saw, an improved device for use in mitering rabbeted metal type and wood type stocks, comprising: (A) a portable panel having a forwardly-rearwardly extending slot to receive the mitering saw; (B) a panel-mounted abutment means including, (1) for metal stock, a rear abutment wall extending on and along the rear side of a vertical plane which converges forwardly toward the panel slot at an angle of about 45° on the rear side of said plane, and, (2) for wood stock, a front abutment edge extending on and along the front side of a parallel vertical plane, which converges forwardly toward the panel slot at an angle of about 135° on the front side of said parallel plane; (C) common scale means associated with said abutment means to provide one set of length dimension calibrations for both types of stock; and (D) common stop means associated with abutment and scale means for determining the operative mitering position required to provide each stock with a mitered rabbet surface length equal to a desired mat-length plus a tolerance.

23 Claims, 13 Drawing Figures

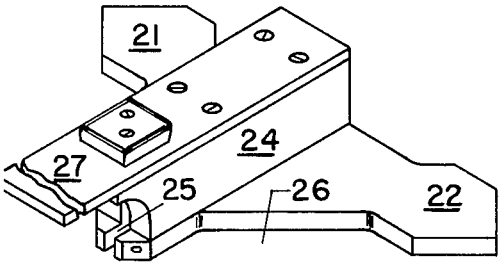
FIG. 5
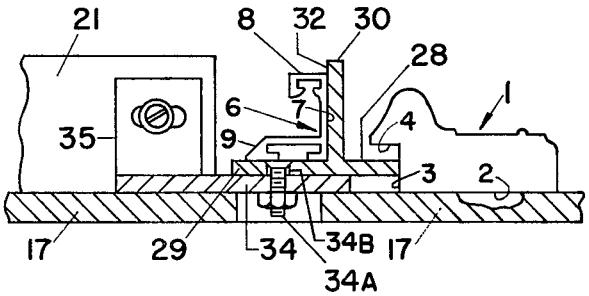
FIG. 6
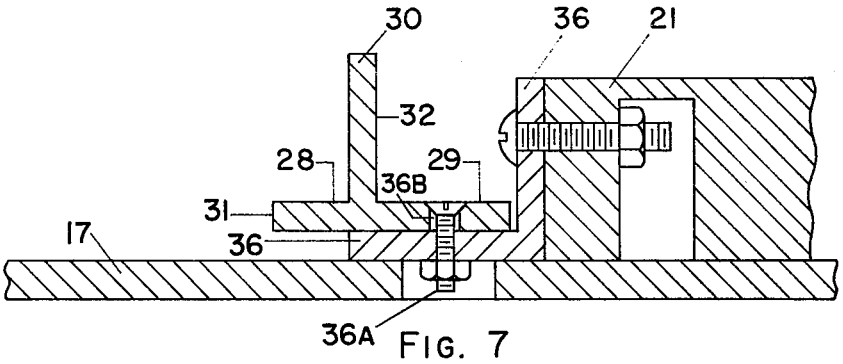
FIG. 7
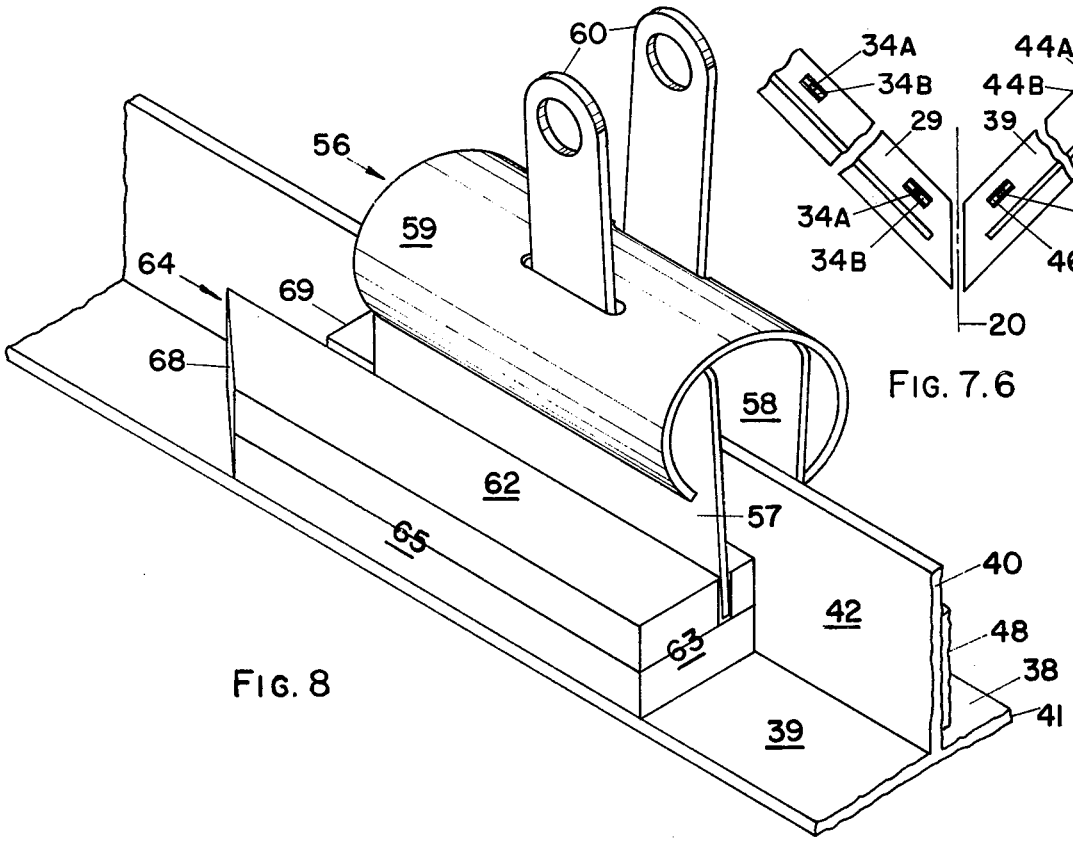
FIG. 8
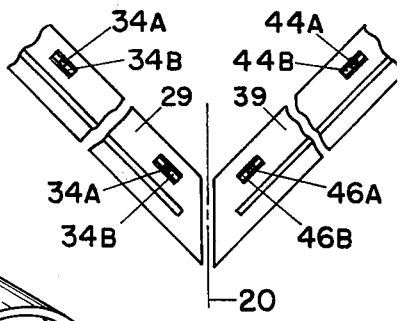
FIG. 7.6

FIG. 9
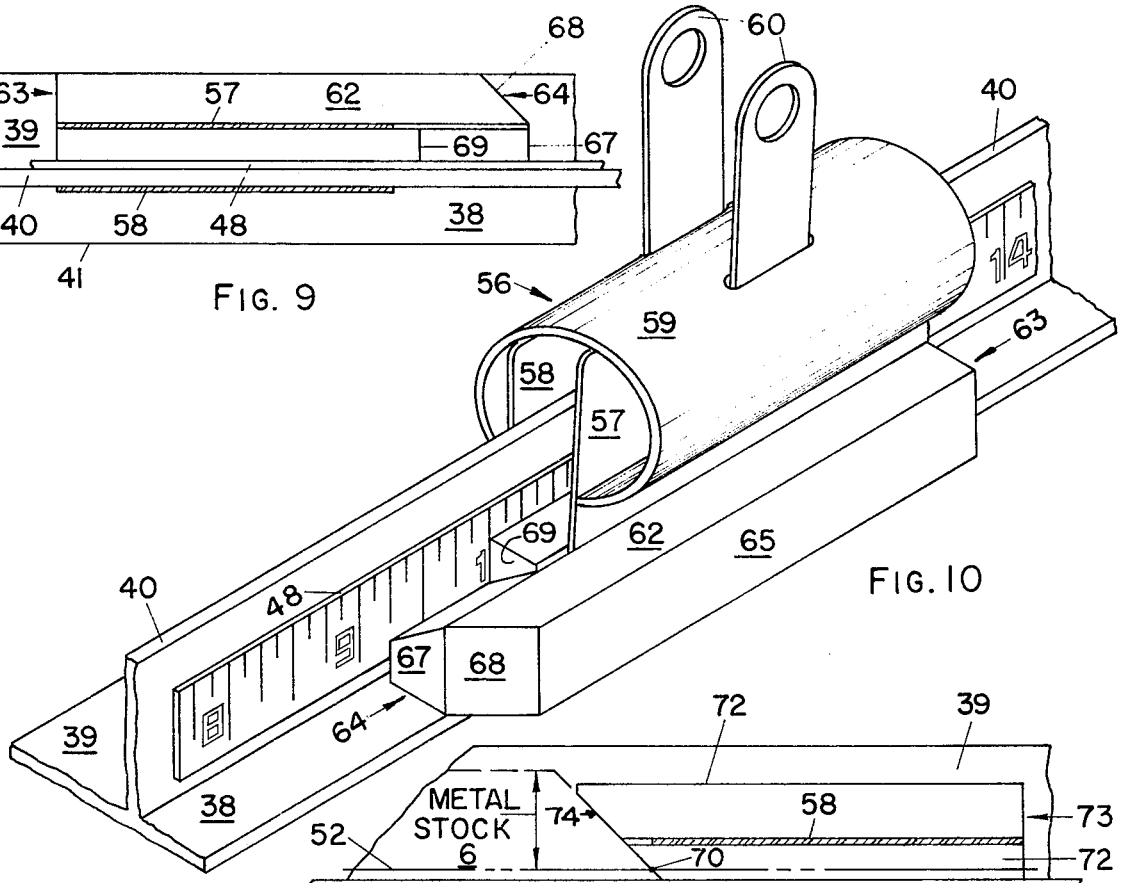
FIG. 10
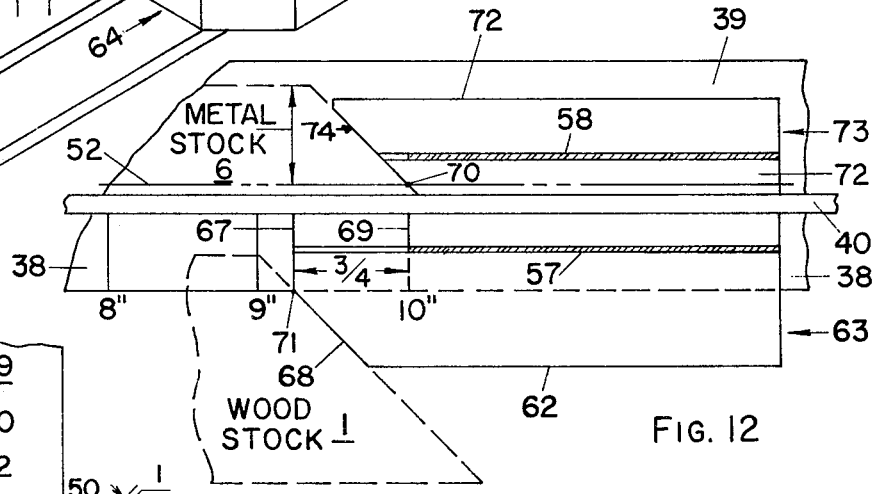
FIG. 12
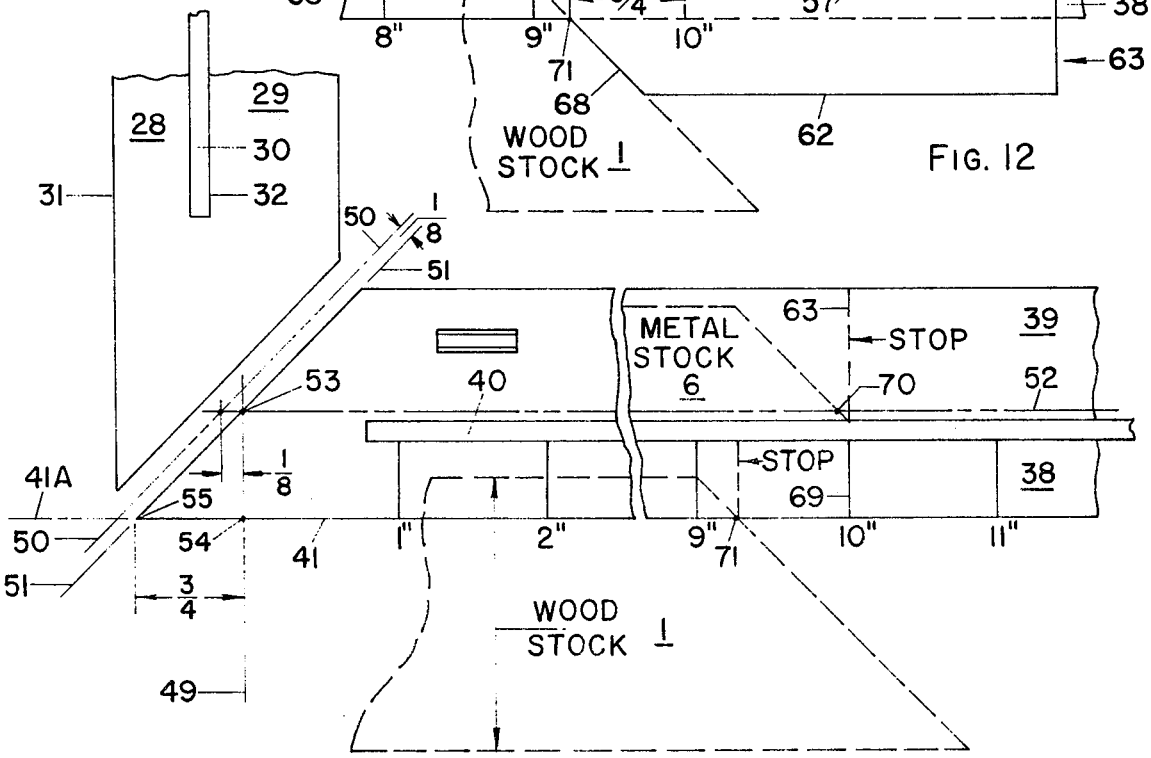
FIG. 11

MITERING DEVICE FOR WOOD AND METAL PICTURE FRAMES

CROSS REFERENCES TO RELATED APPLICATIONS

This application discloses an improvement over the disclosure of my copending application Ser. No. 697,413 filed June 18. 1976.

BACKGROUND OF THE INVENTION

1. Field Of The Invention

This invention relates to the art of making mitered picture frames or moldings and, more particularly, relates to a device for mitering both rectangular wood and metal picture frames.

2. Description Of The Prior Art

So far as I know, wood frames and metal frames are normally cut on different mitering devices. It is possible in some cases to cut them on the same mitering device but normally it is not a recommended procedure.

The Barnes U.S. Pat. No. 556,658 shows a slotted circular panel slidably mountable upon a saw table for longitudinally guided frame cutting and return movements. The panel carries angularly adjustable right and left abutments and abutment clamps for holding the operatively positioned stock while the device is moved to miter the right and left ends of the stock.

The Wales Patent No. 786,583 shows a mitering machine having a pair of slidably mounted stock holders 11, 19, on one of which molding 24 is mounted at one horizontal level to extend at a desired mitering angle across the mitering groove and, on the other of which, molding 25 is mounted at a higher level to extend at a desired angle across the same mitering groove. The two moldings 24, 25, thus fixedly positioned, are mitered when pulled as a unit through the cutting area.

The Kusterle U.S. Pat. No. 1,548,950 shows a mitering machine having a metal triangle pivoted at one apex end and arranged to carry, at its opposite or base end, a pair of straight converging moldings and a curved molding crossing over each of the straight moldings. The metal triangle can be set to one angular position for mitering one straight molding and the adjacent end of the curved molding. Then the triangle is turned angularly to position the other straight molding and the other end of the curved molding for a similar mitering operation.

As seen in FIG. 1, the Thomas U.S. Pat. No. 2,905,210 discloses: a bench saw table 10 having front and rear ends, an upwardly open front-to-rear guide groove 13 and a mitering saw 14 projecting upwardly through a mitering slot 16 in the top of the bench saw table; and a portable mitering attachment removably mountable in groove 13. The attchment comprises: a thick portable circular plywood board or panel 18 having a guide bar 27 on its underside for table guide groove 13; a circular metal plate 19 mounted on the top side of the portable panel 18, calibrated in degrees along its peripheral margin 20 and slotted to receive the mitering saw 14; a saw guard or housing 30 secured to the circular plate 19; a left and right pair of forwardly converging arms 41, 42, each of right angle cross-section having a front upstanding flange or abutment wall 43 and a rear horizontal flange or platform 44, which tapers in width from its wide outermost rear end forwardly to its narrow innermost front end; means 39, 40 pivoting the innermost front end of each of the converging arms 41, 42 to the portable panel unit 18, 19 so that said arms may be swung to various mitering angles including a 45° angle; and a stop 56 mounted on the right vertical abutment wall 43 for movement along the right arm 42 to a desired position. The right vertical abutment wall 43 is on the front side or outside of right arm 42. Its horizontl bottom wall 44 projects rearwardly inward, not forwardly outward, does not terminate in a rabbet-receiving outer front abutment edge and does not underlie the face flange of the rabbet of operatively-positioned stock; it has no scale calibration means, hence, no means designating a calibrated mat-length dimension; and its stop 56 is not mounted for movement to a selected calibration.

The James U.S. Pat. No. 3,830,127 discloses: a saw table 10 carrying a pair of elevated saws 24; and a portable mitering attachment therefor. The attachment comprises: a panel board 28 slidably mounted on the saw table for rearward mitering movement and forward return movement; a pair of left and right elongate rearwardly converging stock abutting assemblies, one for each saw, each assembly having inner and outer sides respectively facing toward and away from the saw plane and being arranged along its outer side to abut the stock or workpiece in an operative elevated position spaced above the panel; means for varying the angle of convergence; means for clamping two workpieces, one to the outer rear side of each of said converging stock abutting assemblies, each clamping means cooperating with the adjacent abutting assembly to carry the clamped elevated workpiece back and forth through mitering and return movements; and a left and right pair of adjustable frictional stop slides, one mounted on each converging assembly for adjusting movement therealong. Each assembly, of the left and right pair of elongate rearwardly converging stock abutting assemblies, includes: a bottom elongate arm 50 fixedly anchored at its rear end to the saw end portion of the panel 28; a lip adjusting plate 76 mounted on top of the arm 50 for laterally-oblique adjustment to the depth of the rabbet; a bridge-like abutment plate 78 overlying and bridging the length of the lip plate 76 and secured at its front and rear ends to the bottom arm 50; a calibrated scale plate 94 overlying the abutment plate 78 and cooperating with it to abut the rim of the face flange of the rabbet; and an adjusting screw 146 for adjusting the adjustable lip plate 76 laterally into abutment with the perimetric surface of the rabbet.

SUMMARY OF THE INVENTION

Objects Of The Invention

My copending application discloses my original rectangular picture frame mitering attachment for any bench saw table having a pair of saw-plane-parallel guide grooves of any spacing in the range normally encountered. My original attachment is simply constructed, inexpensive to manufacture, sufficiently light in weight to render it highly portable, easy to attach to the bench saw table, easy, fast and precise in operation and easy to remove and carry away for storage purposes or other uses. It is primarily suited for mitering rectangular rabbeted wood frames but it has been and is being used by some in mitering rabbeted metal picture frames, which are normally made U-shaped or channel-shaped in cross-section.

The principal object of the present invention is to provide an attachment which is primarily suited for mitering both wood and metal frames.

Another important object is to provide an attachment which is similar to my original attachment; which, in essence, retains the structure of my original mitering attachment and all of its characteristics, advantages, etc., substantially unchanged; and which, through simple and inexpensive means, is additionally adapted for easy, fast and precise operation in mitering rectangular rabbeted metal picture frames over the range of metal frame sizes normally encountered.

Statement Of The Invention

The preferred embodiment of my original attachment comprises: (A) a portable panel having a flat work face, a front end, a rear end and a forwardly-rearwardly extending slot between such ends to receive said mitering saw, (1) said panel being removably mountable on the bench saw table for guided back and forth sliding movement; (B) duplicate panel-mounted left and right abutment means extending along duplicate vertical planes converging forwardly at 45° toward the panel slot, (1) each abutment means providing, along the front side of its plane, a similarly converging front abutment edge which is operative to abut the inner perimetric surface of the rabbet of rabbeted wood stock when such stock is operatively positioned on the panel with its flat back face resting on the flat work face of the panel, (a) said work face and front abutment edge cooperating to provide a bottom support and a horizontally elongate side abutment on and against which said operatively positioned rabbeted wood stock may be held, moved with said panel and mitered during such movement; (C) scale means for calibrating the right front edge in terms of desired (mat or perimetric rabbet surface) length dimensions; and (D) stop means settable to a selected calibration where the calibrated right front edge provides the desired (mat or perimetric rabbet surface) length dimension.

The present invention, as specifically illustrated, involves moving the wood mitering abutment means forwardly away from the saw guard enough to provide an intervening rear space for accommodating the additional abutment means provided for metal picture frame mitering purposes. This additional abutment means, in the intervening rear space adjacent each of the left and right sides of the saw plane, comprises: a horizontally long forwardly-converging narrow member of reversed L-shape, which provides a rear platform or bottom support and a horizontally long upright partition wall presenting a rear vertical abutment on and forwardly against which rabbeted metal stock may be operatively positioned, held, moved with said panel and mitered during such movement. More particularly, unmitered metal stock is operatively positioned on the left side of the saw slot when one of its face flanges rests on the underlying rear platform, which provides a flat bottom supporting surface; when the outer perimetric surface of the bight of the rabbeted metal stock abuts the rear face of said upright partition wall; and when the right end of such stock crosses over the saw plane sufficiently for right end mitering purposes. The once mitered metal stock is operatively positioned on the right side of the saw plane for left end mitering purposes when the same conditions exist, except that the mitered right end also abuts the stop means.

Here it should be clearly understood that the inner surface of the bight of operatively-positioned U-shaped metal stock constitutes its rabbet surface. The vertical plane of that metal surfce intersects a tolerance plane which extends parallel to the plane of the right face of the saw but is spaced a fraction of an inch (usually $\frac{1}{8}$") rightwardly therefrom for tolerance purposes.

To promote the use of the same scale, the same stop means and the same mat-length calibration for both wood and metal frames having mats of the same size, the scale is mounted on the front side of the partition wall where it is equally visible to the framer in setting the stop for either a rear metal mitering or a front wood mitering operation. The zero reference calibration of that scale is located at a point such that a given vertical plane through it intersects the common intersection of the tolerance and metal rabbet planes and forms 45° angles with each of such planes. For metal mitering, the stop is provided with an end abutment which can be positioned foremost on the rear side of said upright partition wall and which can be set directly to the desired mat length calibration, which, in a 10" × 10" frame, is spaced 10" from the common intersection of the tolerance, zero reference and metal rabbet planes.

Here again, it should be clearly understood that the vertical plane of the front edge abutment coincides with the vertical rabbet plane of a wood frame operatively positioned against that front edge abutment and that the intersection of these planes with the tolerance plane constitutes the zero reference point for the 2nd or right-side wood mitering operation. Since the zero reference point for a wood mitering operation is spaced forwardly along the tolerance plane from the zero reference calibration for a metal mitering operation, the length dimension, from the zero reference point for wood to the same 10" calibration, is $\frac{3}{4}$"longer than 10"; hence, the stop is provided with another end abutment, which can be positioned foremost on the front side of the vertical partition wall for wood mitering and which can be set directly to a calibration $\frac{3}{4}$" shorter than the desired mat length calibration, e.g. a $9\frac{1}{4}$" calibration for a 10" × 10" frame. At this setting, the length dimension of the front edge abutment from said zero reference point for wood to the $9\frac{1}{4}$" calibration is 10". To avoid confusion in setting the stop, it is provided between ends with an indicator spaced rearwardly $\frac{3}{4}$" from its wood abutting end. When this indicator is set at the 10" scale calibration, the stop means insures the securement of the correct $10\frac{1}{8}$" rabbet length for a 10" × 10" frame.

BRIEF DESCRIPTION OF THE DRAWINGS

The invention is illustrated in the accompanying drawings wherein:

FIG. 5 is a slightly broken perspective view of an integrated cross frame structure incorporated in my device;

FIG. 6 is an enlarged section taken through lines 6—6 of FIG. 3, this view additionally showing the cross-sectional relationship of operatively positioned metal and wood moldings to the left abutment structure;

FIG. 7 is an enlarged section taken along lines 7—7 of FIG. 4;

FIG. 7.6 is a broken plan view showing the lengthwise adjustment slots for the abutment securing bolts;

FIG. 8 is an enlarged fragmentary perspective view showing the rear side of a stop clamped on the upright partition wall of the right abutment for a metal mitering operation;

FIG. 9 is a partly broken top plan view of the stop means reversed from its FIG. 8 position clamped on the upright partition wall of the right abutment for a wood mitering operation, this view showing the clamping members in horizontal section and the plastic block and the adjacent portion of the right abutment in top plan;

FIG. 10 is a perspective view similar to FIG. 8 but showing the stop mounted for a wood mitering operation;

FIG. 11 is a somewhat schematic view showing the relationship between the right abutment, the wood stock, the metal stock, their respective ends of the stop means, the tolerance plane and the metal and wood reference points in the tolerance plane; and FIG. 12 is a view, corresponding to FIG. 9, showing a modified form of stop means, which doesn't require reversing.

DESCRIPTION OF THE PREFERRED EMBODIMENT

Figure 1:
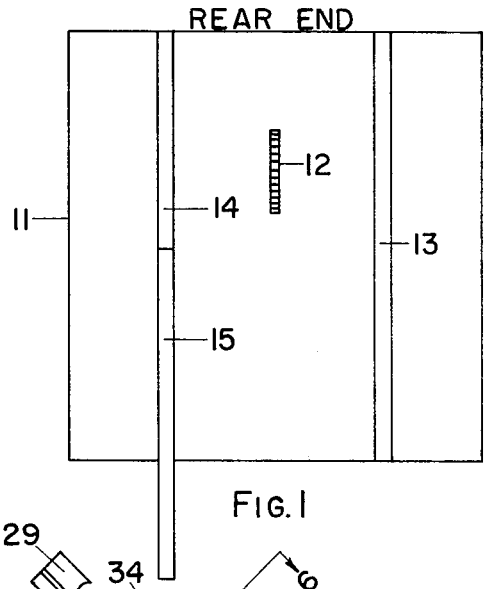
FIG. 1 is a top plan view of a conventional bench saw table with a mitering device guide projecting horizontally from one of the table grooves.

My device is primarily intended for use in mitering rabbeted wood and metal picture frame stock.

WOOD STOCK FRAME MEMBER

A typical wood stock frame member, as seen in cross-section in FIG. 6, has a body 1, a flat back surface 2 and a rabbet characterized by a perimetric rabbet surface 3 and a face flange 4. When these wood members are mitered and assembled to form a rectangular picture frame, the perimetric rabbet surfaces 3 cooperate to form a rear drop-in opening wile the front face flanges 4 cooperate to form a front picture display opening. The size of the mat, which is to be mounted in the wood frame, determines the size designation of the wood frame. Thus, a 10″ × 10″ wood picture frame receives a 10″ × 10″ mat assembly which, for ⅛″ tolerance purposes, is smaller than the (10⅛″ × 10⅛″) drop-in opening formed by the perimetric surfaces 3 and larger than the (9″+ × 9″+) display opening formed by the face flanges 4. The mat assembly is held in a fixed position within the wood frame by any conventional mat retention means.

METAL STOCK FRAME MEMBER

A typical metal stock frame member, as seen in cross-section in FIG. 6, has an inwardly open U-shaped or channel-shaped body 6 providing an outer perimetric surface or bight 7 interconnecting a narrow face flange 8 on the front picture-display side and a somewhat wider face flange 9 on the rear side. When these metal members are mitered and assembled to form a rectangular picture frame, the four wide rear face flanges 9 cooperate to form a rear rectangular opening while the four narrower front face flanges 8 cooperate to form a front rectangular picture-display opening. As before, the size of the mat, which is to be mounted in the metal frame, determines the size designation of the metal frame. Thus, a 10″ × 10″ metal picture frame receives a 10″ × 10″ mat assembly which, for ⅛″ tolerance purposes, is smaller than the 10⅛″ × 10⅛″ opening formed by the inner rabbet surfaces of the bights 7 and larger than the display opening formed by the narrow front face flanges 8. Again, the mat assembly is held in a fixed position within the metal frame by any conventional mat retention means.

Before passing, it may be noted that mitered metal frame members 6 are normally assembled into a picture or like frame by mechanically securing the frame members together at each corner. The rear faces of the rear flanges 9 are provided along their longitudinal centers with a "dove-tail" slot to receive flat right angled frame-interconnecting members which are suitably secured to their respective rear flanges during the assembly operation. Also, mat assemblies are mounted in a metal frame of this character by assembling and securing the last frame member only after the mat assembly ahs been inserted into the three-sided space defined by the three rabbets of the three already assembled and secured frame members.

BENCH SAW TABLE

My mitering device is primarily intended for use on the top surface of a bench saw table 11, such as is seen in FIG. 1, which is drawn on a greatly reduced scale. Any mitering saw operatively associated with the table 11 may be used such as the bench saw 12, which projects upwardly through a saw slot in the table. A pair of left and right longitudinally extending parallel guide grooves 13 and 14 are disposed in the table at equally spaced parallel distances from opposite sides of the saw 12. The left guide groove 14, as shown, contains a slidable guide member 15 for the mitering device projecting horizontally from its front end. This projecting guide member 15 is intended for optional mechanical or adhesive securement in a removable manner to the bottom side of my mitering device.

MITERING DEVICE ELEMENTS

The specific form of my mitering device, as illustrated, comprises at least five elements, viz: (A) a slotted slide panel; (B) an integrated cross-frame structure; (C) panel-mounted abutment means including a pair of left and right converging abutment structures; (D) calibrating means along the right abutment structure; and (E) stop means for use on the right abutment structure.

SLIDE PANEL

Figure 2:
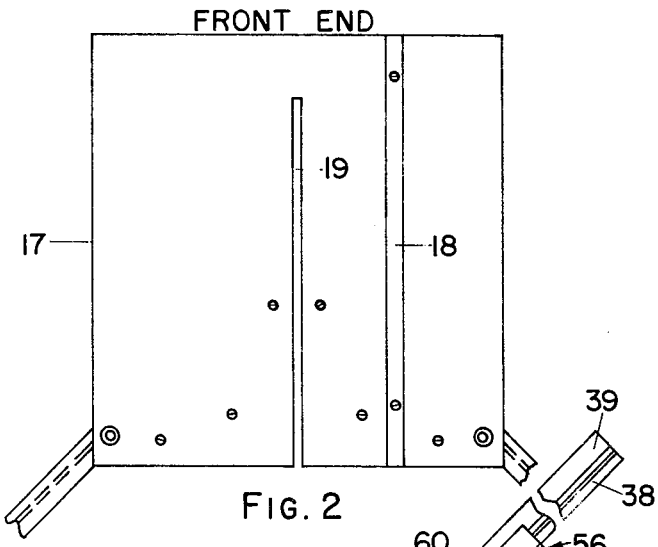
FIG. 2 is a bottom plan view of a mitering device embodying my invention.

FIG. 2, which is drawn on a reduced scale, shows the bottom face of my slide panel 17 with its rear end at the bottom of the figure. The slide panel 17 preferably is composed of strong lightweight plastic having very smooth flat-faced top and bottom surfaces to facilitate sliding. The top surface provides a flat unobstructed work face for slidably engaging the flat back face of the stock being mitered. The panel 17 also has at least one elongate guide member 18 firmly secured to it and intended to fit snugly and slidably within groove 13 of the table. It also has an elongate saw-accommodating slot 19 centrally disposed in the panel to extend longitudinally thereof preferably through the rear end edge of the panel but terminating short of its front end edge. While only one guide member 18 need be used, the use of a second guide member is desired by some framers; hence, the elongate guide member 15 in FIG. 1 may be provided, properly positioned on the bottom face of the panel and either mechanically secured thereto or, preferably, adhesively secured thereto by pressure sensitive adhesive means permitting its firm securement and quick removal whenever desired. Both left and right guide members 15 and 18 are preferably composed of a hard plastic having a smooth surface to facilitate their sliding movements in table grooves 13 and 14.

Since the spacing between the saw slot of the saw table 11 and right and left table grooves 13 and 14 may vary from one make of saw table to another, the right guide member 18 may be mechanically fastened to the slide panel 17 in a removable manner permitting its spacing from the panel slot 19 and its vertical center plane 20 to be varied as and when required by the location of the right table groove 13. The panel may be provided with screw holes or other means marking both positions of guide member 18. Where the panel guide member 15 is to be adhesively secured, its removable securement in a shifted position presents no problem since the regular guide 18 can be placed in its proper shifted table grove 13 with "adhesive" guide 15 placed in its proper shifted table groove 14 whereupon the "adhesive" guide may be firmly secured in proper position simply by pressing the panel 17 downwardly upon "adhesive" guide member 15 to secure it to the panel.

INTEGRATED CROSS FRAME STRUCTURE

Figure 3:
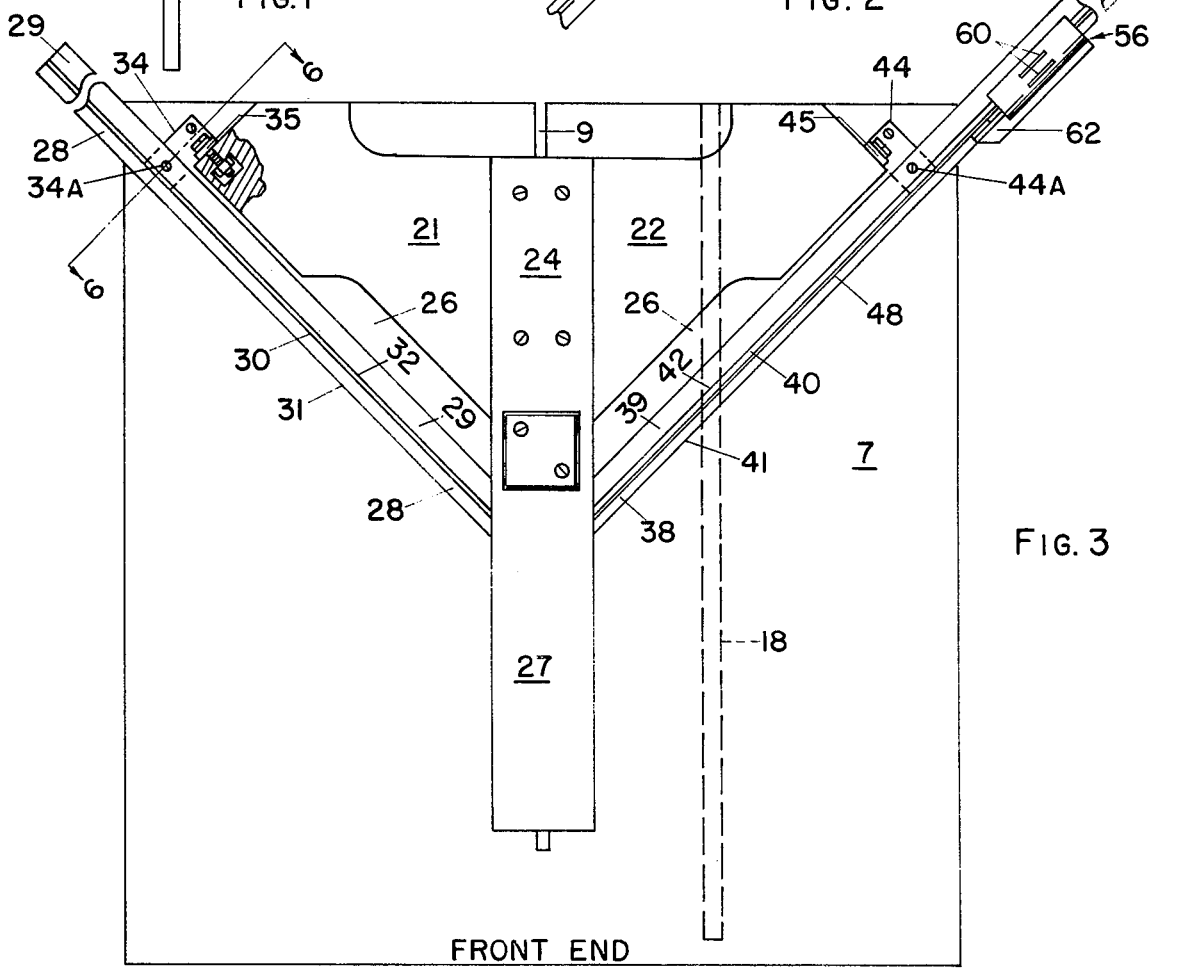
FIG. 3 is a larger scaled partly broken top plan view of the device of FIG. 2, which embodies my invention.
Figure 4:
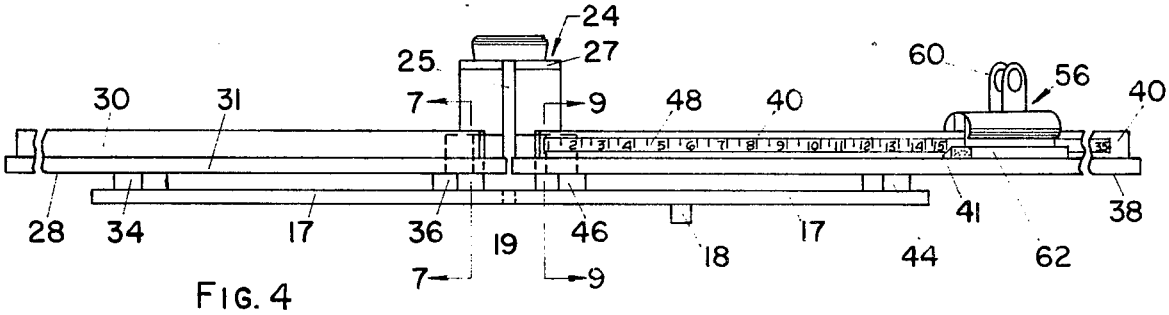
FIG. 4 is an end elevational view looking at the front end of my device, which end is at the top of FIG. 2 and the bottom of FIG. 3, the vertical thickness in this view being enlarged from the top of the front edge abutment to the bottom of the panel for the sake of clarity.

FIG. 3 shows the top face of the integrated cross frame structure on an enlarged scale relative to the scale of FIG. 2 while FIG. 5 shows that structure in perspective. This structure is firmly mounted on the top side of the panel for back and forth movement therewith as a panel-frame unit.

This cross frame structure, as illustrated particularly in FIGS. 3 and 5, comprises: a pair of left and right wing frame members, one in each side of the rear end portion of the panel slot 19; and a saw guard or housing secured to the wing frames in position to bridge the panel slot 19.

In the arrangement illustrated, the left and right wing members 21 and 22 extend along the left and right sides respectively of the slot 19 and form an underlying part of the saw guard or housing 24 bridging over slot 19. The wing frames 21, 22 and saw guard 24 cooperatively form a triangle across the rear end portion of the panel. The rear end edge of this triangle extends along the rear end edge of the panel 17 from opposite sides of the panel slot 19 to about the left and right rear corners thereof. The central portion of the integrated cross frame extends forwardly a distance such that the longitudinal rear-toward-front length of the saw guard housing is sufficient to accommodate the table saw 12. The left and right front edges of the left and right wing frames 21, 22 converge toward each other and terminate on opposite sides of the panel slot 19. Each wing frame is preferably composed of thick (say 1") light weight material, such as fiberboard, chipboard, etc. Each wing frame is firmly secured to the top face of the panel in any suitable way. I prefer to glue-bond the wing frames to the panel and then supplement the glue-bond by screws, one screw adjacent each of the three corners of each frame.

The saw guard or housing 24 may be composed of any suitable material. I prefer the use of very hard dense wood such as a block of maple, extending longitudinally over the rear longitudinal end portion of the panel slot 19. The block is provided with asaw-accommodating centrally-disposed slot 25. The bottom of the saw guard housing 24 may be glue-bonded or otherwise secured directly to the panel adjacent panel slot 19. I prefer, however, to extend the wing frames underneath the saw guard housing and bond the saw guard housing 24 to the top surface of the wing frames so that they both cooperate to form the center slot 25 of said integrated cross frame.

As noted before, the panel-frame unit, resulting when the wing frame 21 and 22 are secured to the panel 17, is characterized by forwardly converging front peripheral edges. For handhold purposes, each wing frame is recessed at 26 between its front center and rear corner portions; hence, the converging front edges are discontinuous.

To promote safety, the roof plate of the saw guard housing may be extended forwardly to provide a canopy 27 so that a roof extends over the saw during the entire rearward travel of the panel 17 relative to the saw.

PANEL-MOUNTED ABUTMENT MEANS

The panel-mounted abutment means includes: a pair of substantially identical left and right or 1st and 2nd abutment structures mounted on the left and right sides of the slide panel 17 to converge from the rear corners of the panel forwardly at a 90° angle toward each other and at a 45° angle toward the panel slot where they terminate on opposite sides thereof; and left and right abutment securing means. Both left and right abutments may be composed of any suitable material, such as stainless steel, aluminum, magnesium, etc. and fashioned in any suitable shape.

Left Abutment Structure

Preferably, the left abutment structure is fashioned in the form of a horizontally-elongate aluminum extrusion of inverted T-shape in cross-section wherein: the bottom (1½" wide) bar of the T provides a front and rear pair of horizontally long narrow bottom flanges or platforms, namely, a front (½" wide) platform 28 and a rear (7/8" wide) platform 29; while the upright (⅛" thick) stem of the T provides a horizontally long narrow upright partition wall 30 between platforms.

In the left abutment structure, the long front edge of the converging front platform 28 functions as a side abutment surface 31 for the perimetric rabbet surface 3 of operatively positioned wood stock. Similarly, the long rear face 32 of the converging partition wall 30 functions as a side abutment 32 for the outer perimetric surface or bight 7 of operatively positioned metal stock.

Left Abutment Securing Means

As seen in FIGS. 3, 6 and 7, the opposite or left and right ends of the left abutment structure are secured, through a pair of appropriate fittings, to the respective adjacent rear and front corners of the left triangular half of the cross-frame structure. Thus, as seen in FIG. 6, the left end of the left abutment structure 28–32 is screwed to the underlying portion of a bracket 34, which elevates the left abutment structure about ⅛" more or less. The rear end portion of bracket 34 is suitably screwed, through an upstanding flange 35 along its right marginal edge adjacent its rear end, to the thick vertical edge of the adjacent cross-frame structure.

As seen in FIG. 7, the right end of the left abutment structure 28–32 is screwed to the underlying foot of an L-shaped bracket 36, which also elevates that end of the left abutment structure about ⅛" more or less above the top work face of the panel 17. The leg of the L-shaped bracket 36 is screwed to the thick (1") vertical edge of the adjacent cross-frame-structure. While other suitable modes of securement may be employed, preferably all of the foregoing left and right end securements of the left abutment are effected in the same manner specifically described and illustrated in my copending U.S. application, subject to the lengthwise adjustment feature explained hereinafter following the explanation of the right abutment structure and securing means.

Right Abutment Structure

The construction of the right front abutment structure is identical to that of the inverted T-shaped left abutment structure 28–32 except: that the right abutment structure illustrated is longer than the left; and that it diverges rearwardly to the right instead of to the left. It should, therefore, suffice to say that the right abutment structure comprises: front bottom platform 38; rear bottom platform 39; and interposed upright partition wall 40. In the right abutment structure, the long front edge 41 of the converging front bottom platform 38 functions as a side abutment surface 41 for the perimetric rabbet surface 3 of wood stock. Similarly, the long rear face 42 of the converging partition wall 40 functions as a side abutment 42 for the outer perimetric surface or bight 7 of operatively positioned metal stock.

Right Abutment Securing Means

The elevation, securement and support of the right front abutment structure is identical to the elevating, securing and supporting means 34–36 of the left abutment structure; hence, it should suffice to say that it includes: a right end bracket 44; its upstanding flange 45; and a left end L-shaped bracket 46. Again, preferably all of the foregoing left and right end securements of the right abutment structure are specifically effected in the manner shown in my aforesaid copending U.S. application.

Lengthwise Adjustment of Both Abutments

The saws 12 of all bench tables 11 are not always centered on the center plane 20 of the panel slot 19 when the panel is operatively mounted on the table 11. As a matter of fact, the major center plane of saw 12 on one table may be offset as much as ⅛" to the left of the panel slot center plane 20 and, in some other seemingly identical table, offset to the right. When this occurs, the left and right abutment structures should be individually shifted lengthwise to the left if the major plane of the saw is offset to the left of panel slot plane 20 and lengthwise to the right if the major saw plane is offset to the right. In each case, the abutments are shifted to bring their adjacent mitered end edges closely adjacent to but spaced very slightly from the opposite faces of the offset saw. These adjustments, when properly made, normally eliminate the tendency of the saw to kick the stock forwardly during the mitering operation.

Accordingly, the rear platform 29 of the left abutment structure 28–32 is arranged to receive the securing screw **34*a* of the left rear end bracket 34 through a slot 34*b* and to receive the securing screw 36*a* for the L-shaped right front end bracket 36 through an adjusting slot 36*b*. Both slots 34*b* and 36*b* are elongated in the direction of the length of the rear platform 29** so that the left abutment structure can be shifted to the left or right to the extent required by the offset.

The rear platform 39 of the right abutment structure 38–42 is similarly provided with rear-end and front-end slots **44*b* and 46*b* to receive the right abutment securing screws 44*a* for the right rear end bracket 44 and 46*a* for the L-shaped left front end bracket 46**.

RIGHT ABUTMENT CALIBRATION SCALE

The calibration means for the right abutment structure 38–42 comprises a calibrated scale or rule 48. It may be formed in or otherwise associated with the right abutment structure in any suitable way. Preferably, a physically-separate calibrated scale 48 is firmly secured to the front face of the partition wall 30 of the right abutment. Preferably, it extends so near the upper edge of that partition wall 30, that its calibrations are readily visible for both wood mitering and metal mitering purposes.

Before describing the precise position where the scale 48 is placed on the right abutment for stock mitering purposes, certain vertical planes, which are associated with the right abutment and which are shown in FIG. 11, should be identified, namely: the front abutment edge plane 41A of the front abutment edge 41 for a wood stock frame member, this plane coinciding with the "vertical rabbet plane" of operatively positioned wood stock; the "zero calibration plane" 49 which passes through the zero calibration of scale 48 at a right angle to both the front abutment edge 41 and the rear abutment face 42 of partition wall 40; the "saw face plane" 50 of the adjacent right face of the saw; the "tolerance plane" 51 which is spaced ⅛" to the right of saw face plane 50 and parallel thereto; and the "inner bight plane" 52 of the inner surface of the bight 7 of a metal stock frame member 6 when that member is operatively positioned on the rear side of the right abutment to the extent of having its bight 7 pressed forwardly against the rear surface 42 of partition wall 40 with one of its face flanges 8, 9, preferably its wide rear face flange 9, resting on the rear platform 39.

Scale For Metal Stock Mitering

For metal stock mitering purposes, the scale 48 is located on the right abutment with its zero calibration plane 49 intersecting the tolerance plane 51 and the inner bight plane 52 along the same vertical intersection line 53. As a consequence, the intersection line 53 of the zero calibration plane 49 with planes 51–52 represents the zero inch (0") beginning of a given mat length dimension of a mat for metal stock; hence, the 10" calibration of the scale, as an example, will be located 10" to the right of line 53 while, in the preferred embodiment, the desired ⅛" tolerance is provided on the left between that common intersection line 53 and the saw plane 50.

Scale For Wood Stock Mitering

For wood stock mitering purposes, a separate scale may be used with its zero calibration plane intersecting planes 41A and 51 along a common vertical line. But one common scale 48 is preferred for both wood and metal mitering. In this connection, it will be noted that where the rabbet abutment plane 52 for metal intersects both the zero calibration plane 49 and tolerance plane 51 along vertical line 53, the rabbet abutment plane 41A for wood intersects the zero calibration plane 49 along one line 54 and the tolerance plane 51 along another line 55, which is spaced leftwardly from line 54. In the arrangement illustrated, this leftward spacing is ¾". Consequently, in order to facilitate the use of the same calibration scale 48 for both wood stock and metal stock, the corresponding wood stock mat length and end-to-end perimetric rabbet surface length dimensions must be shifted ¾" to the left. The preferred way of accomplishing this shift is best brought out in connection with the explanation of the stop means.

Stop Means

The stop means, which is releasably clamped to partition wall 40 and thus mounted for adjustment, along the upper margin of the right abutment, to a selected scale calibration, comprises: a spring clip; and a stop block.

As best seen in FIGS. 8 and 10, the spring clip 56 is of a conventional clip-board type comprising: a pair of downwardly extending clamping members 57, 58; a slotted cylindrical spring 59 biasing the clamp closed; and a pair of upwardly-extending fingers 60 for manually opening the clamp, one finger for each clamping member, each finger being an extension of its clamping member.

The stop block illustrated comprises: a block of suitable material such as wood or plastic, preferably plastic 62. The block is firmly secured to the lower edge portion of one clamping member, say 57, as seen in FIG. 8. The other clamping member 58 is free of plastic and free for relative clamping-unclamping movement. The horizontal perimeter of the block 62 includes: a flat inner clamping wall between clamping members 57, 58; opposite ends 63, 64; and a flat outer wall 65 which may be and preferably is parallel to the opposite flat inner clamping wall of the stop means.

The end face of end 63 functions as an abutment in metal mitering operations. As shown, it is square cut to extend at a right angle to the rear face 42 of partition wall 40 when the spring is clipped to that wall as seen in FIGS. 8 and 9.

The end face of the opposite end 64 of the stop block 62 functions as an abutment in wood mitering operations. It preferably contains two successive portions across its width, viz: a square cut inner face 67, which is adjacent the scale when the stop is clipped to the partition wall as seen in FIG. 10; and a 45° mitered outer face 68, extending from the inner face 67 to the outer wall 65 of the block. Its 45° miter conforms to the mitered right end of wood stock, which is operatively positioned on the right abutment for left end mitering purposes.

The stop block 62 is also provided with an indicator 69 between the right end face 64 on the extreme left, as seen in FIG. 10, and the adjacent end of the clamping member 57. This indicator 69 is spaced ¾" rightwardly from square cut end face 67 so that the stop means may be properly set for wood mitering by placing the indicator 69 at the 10" mat length calibration for a 10" × 10" wood frame.

MITERING OPERATIONS GENERALLY

In operation, we will assume: that the mitering device is operatively positioned on a saw table for slidable movement; and that each of the four moldings, of a rectangular 10" × 10" metal or wood frame, has a rabbet surface length of 10⅛" so that it will cooperate with other frame members to form a 10⅛" × 10⅛" space to receive a 10" × 10" mat assembly with a built-in tolerance of ⅛". We also assume that the framer starts with unmitered molding stock, say 5' long.

Metal Mitering Operations

With these assumptions, unmitered metal stock 6 is 1st placed on the rear side of the left partition wall 30 of the left abutment structure. As seen in FIG. 6, it preferably has its wide face flange 9 pressed downwardly against panel 17 or, more aptly, against the rear platform 29, with the outer perimetric surface of its bight 7 pressed forwardly against the rear face 32 of partition wall 30 and with its right end extending across the path of saw 12 just sufficiently for mitering purposes. The left handhold recess 26 between cross frame 21 and the left abutment structure readily permits the framer to hold the metal stock fixedly in its aforesaid operative mitering position while the framer moves the panel and the stock as a fixed unit rearwardly to the extent required to miter the right end of the metal stock.

For the next mitering operation on the same metal stock, the stop means on the right abutment is spring clipped or clamped over the top edge of the upright partition wall 40 of the right abutment in the manner shown in FIG. 8. Here the square cut end face 63 is positioned on the rear side of the right abutment at the 10" calibration of scale 48. The metal stock is now placed on the rear side of the partition wall 40 of the right abutment structure preferably with its wide face flange 9 pressed downwardly against the rear platform 39 of the right abutment structure, with its outer perimetric bight surface 7 pressed forwardly against the rear face 42 of the partition wall 40 of the right abutment structure, with its mitered right end abutting the square cut end face of end 63 and with the remaining length of the metal stock projecting leftwardly toward and through the slot formed by the adjacent ends of the left and right abutment partition walls 30 and 40. The adjacent ends of these partition walls are cut away sufficiently to form a slot large enough to permit the passage of the metal stock therebetween. Now the right handhold recess 26 readily permits the framer to hold the metal stock fixedly in its aforesaid operative mitering position while the framer again moves the panel and the metal stock as a fixed unit rearwardly to the extent required to miter the left end of the stock.

Before passing, it may be observed that, as seen in FIG. 11, the extreme right end 70 of the inner bight surface of operatively positioned metal stock 6 is spaced, to the left of square cut end 63, a distance approximating one-half of the thickness of bight 7. As a consequence, the conventional ⅛" tolerance and the end-to-end length of that inner bight surface are reduced approximately 1/32" where the thickness of the bight is about 1/16". This variation is of no practical consequence.

Wood Mitering Operations

Unmitered wood stock is 1st placed on the front side of the partition wall 30 of the left abutment structure preferably with its back surface 2 pressed downwardly against panel 17, with its perimetric rabbet surface 3 pressed rearwardly against the front abutment edge 31 of front platform 28 and with its right end extending across the saw plane just sufficiently for mitering purposes. The left handhold recess 26 again permits the framer to hold the stock fixedly in its operative mitering position while the framer moves the panel and wood stock to miter the right end of the stock.

For the left end mitering operation on the same wood stock, the stop means is horizontally rotated from its FIG. 8 position to its FIG. 10 position and spring-clipped or clamped over the top edge of the upright partition wall 40 of the right abutment with the indicator 69 located at the 10″ calibration of scale 48 as in FIG. 10. The wood stock is now placed on the front side of the partition wall 40 of the right abutment structure with its back surface 2 pressed downwardly against the top surface of panel 17 with its perimetric rabbet surface 3 pressed rearwardly against the front abutment edge 41 of the front platform 38, with its mitered right end abutting the mitered end face 68 of end 64 of the stop and with the remaining length of the wood stock projecting leftwardly toward and through the slot formed by the adjacent ends of the left and right partition walls 30 and 40.

In this operative wood mitering position, the distance along wood rabbet plane 41A from the zero calibration plane 49 to indicator 69 and from tolerance plane 51 to the far end of rabbet 3, where it intersects the mitered stop face 68, is exactly 10″. The end-to-end length of rabbet 3 from its intersection with the right face plane 50 of the saw and the intersection of rabbet 3 with stop 68 is exactly 10⅛″. Now the right handhold recess 26 again permits the framer to hold the wood stock fixedly in its aforesaid operative mitering position while the framer moves the panel and the wood stock rearwardly as a fixed unit to the extent required to complete the left end mitering operation.

It will be appreciated that my rectangular frame mitering attachment is simply constructed, inexpensive to manufacture, light in weight, highly portable, easy to attach to the bench saw table, easy to load and unload with the stock to be mitered, operable for mitering both metal and wood picture frames over the range of frame widths normally encountered, easily and rapidly operated to effect all mitering operations and easy to remove and carry away for storage purposes or other uses.

The words "right", "left", "front", and "rear" are used herein for the sake of promoting clarity by way of concrete example and are not to be viewed as limitations.

MODIFICATIONS

The left and right abutments may, if desired, be reversed so as to place the calibrated abutment on the left half of the panel or they may be mounted on entirely separate panels.

A stop means, which must be used in the FIG. 8 way for metal mitering operations and then horizontally rotated or reversed for use in the FIGS. 9 and 10 way for wood mitering operations, is not essential. Thus, a stop means, which does not require reversing, may be employed. For example, means, providing a square cut end face, corresponding to end face 63, may be mounted on clamping member 58 with its square cut end face arranged for transverse alignment with the adjacent indicator 69 on clamping member 57.

The modified arrangement shown in FIG. 12, however, is preferred. Here, another plastic block 72 is mounted on rear clamping member 58 with one end 73 at its right, with its opposite end 74 at its left and with its left end 74 so mitered (at 45°) as to place the extreme right end 70 of the mitered inner perimetric surface of the rabbet or bight of operatively positioned metal stock 6 directly opposite from and transversely aligned with indicator 69. This will eliminate the slight previously mentioned "1/32" tolerance variation which occurs with a square cut end 63.

In this case, the stop is placed at one setting for metal and wood mitering operations for frames of the same mat-length by aligning indicator 69 with the desired mat length calibration, e.g. 10″ for 10″ × 10″ frames, 12″ for 12″ × 12″ frames, etc. Metal stock is then mitered on the rear side of the right abutment with its right end abutting the 45° mitered stop 74 provided on clamping member 58 while wood stock is mitered on the front side as before.

It may be helpful to note: that, in FIG. 11, the extreme left ends of the rabbet surfaces of operatively positioned metal and wood stock respectively correspond to vertical plane intersection lines 53 and 55; and that, in FIG. 12, the extreme right ends of such rabbet surfaces respectively correspond to vertical intersection lines 70 and 71.

Having described my invention, I claim:

1. In the art of making mitered picture frame members on a work table associated with an operatively mounted mitering saw, an improved device for use not only in mitering channel-shaped metal picture-frame stock having front and rear face flanges and an interposed bight presenting an outer perimetric bight surface and an inner perimetric rabbet surface but also in mitering wood picture-framestock having an inner perimetric rabbet surface and, along respective front and rear sides thereof, a front face flange and a back face, comprising:

A. a portable panel having a flat work face, a front end, a rear end and a forwardly-rearwardly extending slot between such ends to receive said mitering saw,
   1. said panel being removably mountable on said work table for guided back and forth sliding movement;

B. one abutment means for metal stock mounted on the panel to extend on the rear side of a vertical plane which converges forwardly toward the panel slot at an angle of about 45° on the rear side of said plane where said one means provides a similarly converging rear abutment wall,
   1. the rear face of said rear wall being operative to abut the outer bight surface of channel-shaped metal stock when such stock is operatively positioned on the panel with one of its face flanges resting on an underlying panel-supported flat surface,
      a. said underlying surface and rear abutment wall cooperating to provide a bottom support and rear side abutment on and forwardly against which said operatively positioned rabbeted metal stock may be manually held, moved rearwardly with said panel and mitered at about 45° during such movement; and C. another abutment means for said rabbeted wood stock mounted on the panel to extend on the front side of a parallel vertical plane, which converges forwardly toward the panel slot at an angle of about 135° on the front side of said parallel plane where it provides a similarly converging front abutment edge,
   1. the front face of said front edge being operative to abut the inner perimetric rabbet surface of said wood stock when said wood stock is operatively positioned on the panel with its back face resting on the flat work face of the panel,
      a. said panel work face and said front abutment edge respectively providing a bottom support and front side abutment on and rearwardly against which said operatively positioned rabbeted wood stock may be manually held, moved rearwardly with said panel and mitered at about 45° during such movement.

2. The device of claim 1 wherein:

A. a pair of said one abutment means is mounted on the panel, one on each side of said panel slot, each converging toward the other and cooperatively forming an angle of about 90° on their rear sides.

3. The device of claim 1 including:

A. scale means associated with said one abutment means for calibrating the inner perimetric rabbet surface of metal stock operatively positioned on the rear side of said converging abutment wall, 1. said calibrations being in terms of length dimensions beginning with a reference point in the vicinity of the saw plane.

4. The device of claim 3 wherein:

A. said reference point corresponds to the zero calibration of said scale means and said zero calibration is spaced from the plane of the adjacent face of the saw a distance approximating a desired tolerance for the mat of the ultimate metal picture frame.

5. The device of claim 3 including:

A. stop means settable to a selected calibration of said scale means and operative, when set, to insure that operatively positioned metal stock presents, between the stop means and the plane of the adjacent face of the saw, the end-to-end length dimension desired of its perimetric rabbet surface.

6. The device of claim 5 wherein:

A. said scale means has its reference point correspond to its zero calibration, which is spaced, from the plane of the adjacent face of the saw, a distance approximating a desired tolerance for the mat of the ultimate metal picture frame; and B. said selected calibration designates the length dimension of one side of a given mat.

7. The device of claim 1 including:

A. a common abutment means providing said abutment means for metal stock on the rear side of said vertical plane and said other abutment means for wood stock on the front side of said parallel vertical plane.

8. The device of claim 7 wherein:

A. said common abutment means includes a horizontally elongate extrusion of inverted T-shape in cross-section, 1. the rear side of the stem of the inverted T providing said abutment wall for metal stock, 2. the front edge of the horizontal bar of the inverted T providing said front abutment edge for wood stock.

9. The device of claim 7 including:

A. common scale means associated with said common abutment means for calibrating the inner perimetric rabbet surface 1. of metal stock operatively positioned on the rear side of said converging rear abutment wall and 2. of wood stock operatively positioned on the front side of said converging front abutment edge.

10. The device of claim 9 including:

A. stop means associated with said common abutment means and settable thereon to a selected mat-size calibration of said scale-means for both metal and wood stock frame members of the same mat size, 1. said stop having one end portion for abutting operatively positioned metal stock at one scale point providing the desired end-to-end inner perimetric surface length between the stop and the plane of the adjacent face of the saw, and 2. said stop means having another end portion for abutting operatively positioned wood stock at a different scale point providing the same desired end-to-end inner perimetric surface length between the stop and the plane of the adjacent face of the saw.

11. The device of claim 10 wherein:

A. said stop means has an indicator for designating a desired setting, for a given mat;

B. said metal abutting end portion and said wood abutting end portion are at the same end of the stop means but on opposite sides of said vertical abutment wall when the stop is set;

C. one of said end portions of the stop means is transversely aligned with said indicator; and D. the other of said end portions of the stop means is spaced from the transverse plane of said indicator to compensate for the difference in length from the transverse indicator plane to the plane of the adjacent face of the saw along the inner perimetric planes of operatively positioned metal stock on the rear side of said converging vertical plane and operatively positioned wood stock on the front side thereof.

12. The device of claim 1 wherein:

A. the saw-receiving slot of the portable panel has a longitudinal vertical plane which, when the portable panel is operatively mounted on the work table, should coincide with the major vertical center plane of the saw; and B. means for adjusting the common abutment means lengthwise to accommodate an offset between the vertical longitudinal plane of the slot and the major vertical center plane of the saw.

13. The device of claim 12 wherein:

A. the abutment adjusting means includes 1. a bracket rigidly mounted on the portable panel, 2. a screw clamping the abutment means to the bracket, and 3. a lengthwise adjustment slot in the abutment means through which the securing screw passes.

14. In the art of making mitered frame members on a work table associated with an operatively mounted mitering saw, an improved device for use in mitering metal type stock and wood type stock, comprising:

A, a portable panel having a flat top work face, a front end, a rear end and a forwardly-rearwardly extending slot between such ends to receive said mitering saw, 1. said panel being removably mountable on said work table for guided back and forth sliding movement; and B. abutment means including, 1. for one type of stock, one abutment means mounted on the panel to extend on and along the rear side of a vertical plane which converges forwardly toward the panel slot at an angle of about 45° on the rear side of said plane, and, 2. for the other type of stock, another abutment means mounted on the panel to extend on and along the front side of a parallel vertical plane, which converges forwardly toward the panel slot at an angle of about 135° on the front side of said parallel plane.

15. The device of claim 14 wherein:

A. said one and another abutment means are integrated with each other to extend on opposite rear and front sides of a common vertical plane.

16. The device of claim 15 for use in mitering the unmitered end of once mitered stock including:

A. common scale means associated with said integrated abutment means to provide one set of length dimension calibrations for both types of stock.

17. The device of claim 16 including:

A. common stop means
1. associated with said integrated abutment means and said common scale means,
2. settble to a selected calibration of said common scale, and
3. operative, when set, to insure that stock, operatively positioned on a given side of said abutment means, presents, between the stop means and the plane of the adjacent face of the saw, a desired mitered end-to-end length dimension.

18. The device of claim 15 for use in mitering channel-shaped metal picture-frme stock having front and rear face flanges and an interposed bight presenting an outer perimetric bight surface and an inner perimetric rabbet surface, wherein:

A. said one abutment means provides, for metal stock on the rear side of said common converging plane, a similarly converging abutment wall,
1. the rear face of said wall being operative to abut the outer bight surface of channel-shaped metal stock when such stock is operatively positioned on the panel with one of its face flanges resting on an underlying panel-supported flat surface,
a. said underlying surface and said rear abutment-wall face cooperating to provide a bottom support and side abutment on and forwardly against which said operatively positioned rabbeted metal stock may be manually held, moved rearwardly with said panel and mitered at about 45° during such movement.

19. The device of claim 14 for use in mitering wood picture frame stock having, along respective front and rear sides of an inner perimetric rabbet surface, a front face flange and a back face, wherein:

A. said other abutment means provides, for said wood stock on the front side of said parallel converging plane, a similarly converging front abutment edge,
1. the front face of said edge being operative to abut the inner perimetric rabbet surface of said wood stock when such stock is operatively positioned on the panel with its back face resting on said top work face of the panel,
a. said top work face and said front abutment edge cooperating to provide a bottom support and side abutment on and rearwardly against which said operatively positioned rabbeted wood stock may be manually held, moved rearwardly with said panel and mitered at about 45° during such movement.

20. The device of claim 19 for use in mitering channel-shaped metal picture-frame stock having front and rear face flanges and an interposed bight presenting an outer perimetric bight surface and an inner perimetric rabbet surfce, wherein:

A. said one abutment means provides, for metal picture-frame stock on the rear side of said common converging plane, a similarly converging abutment wall,
1. the rear face of said wall being operative to abut the outer bight surface of channel-shaped metal stock when such stock is operatively positioned on the panel with one of its face flanges resting on an underlying panel-supported flat surface,
a. said underlying surface and said rear abutment-wall face cooperating to provide a bottom support and side abutment on and forwardly against which said operatively positioned rabbeted metal stock may be manually held, moved rearwardly with said panel and mitered at about 45° during such movement.

21. The device of claim 20 for use in mitering the unmitered end of once mitered picture-frame stock, including:

A. common scale means associated with said integrated abutment means for calibrating it with one set of mat-length dimensions for both types of stock,
1. said calibrations having a reference point in the vicinity of the saw plane.

22. The device of claim 21 wherein:

A. said reference point corresponds to the zero calibration of said scale means and said zero calibration is spaced from the plane of the adjacent face of the saw a distance approximating a desired tolerance for the mat of the ultimate metal picture frame.

23. The device of claim 22 including:

A. common stop means associated with both of said integrated abutment and common scale means, said stop means
1. providing front and rear stops for the respective front and rear sides of said abutment means,
2. having a scale calibration indicator for determining the operative position to which the stop means should be set or scaled on the abutment means for the mitering of said unmitered end, and
3. being operative, when operatively positioned
a. for rabbeted wood stock, to provide, between the front stop and the plane of the adjacent face of the saw, a perimetric rabbet surface length equal to said mat length plus said tolerance, and
b. for rabbeted metal stock, to provide, between the rear stop and the plane of the adjacent face of the saw, a perimetric rabbet surface length equal to said mat length plus said tolerance.

* * * * *